United States Patent [19]

Allen

[11] 4,190,175

[45] Feb. 26, 1980

[54] CONTAINER AND CLOSURE CONSTRUCTION FOR RESISTING TAMPERING

[75] Inventors: David O. Allen, Wilmington, Ohio

[73] Assignee: Buckeye Molding Company, New Vienna, Ohio

[21] Appl. No.: 670,235

[22] Filed: Mar. 25, 1976

[51] Int. Cl.[2] ..... B65D 41/30

[52] U.S. Cl. ..... 220/270; 215/256; 220/276; 215/32; 220/306

[58] Field of Search ..... 220/266, 270, 276, 306; 215/201, 250, 254, 256

[56] References Cited

U.S. PATENT DOCUMENTS

| | | | |
|---|---|---|---|
| 3,716,162 | 2/1973 | Botkin | 215/316 |
| 3,840,152 | 10/1974 | Hodge | 220/306 |
| 3,841,512 | 10/1974 | Botkin | 215/256 |
| 3,858,748 | 1/1975 | Marco | 220/276 |

*Primary Examiner*—George T. Hall

*Attorney, Agent, or Firm*—Dybvig & Dybvig

[57] ABSTRACT

A molded plastic container and closure assembly comprises a container having an upstanding wall adapted to be embraced by the depending skirt of a closure member. To resist tampering or unauthorized removal of the closure, the container has an integrally molded wall means projecting radially outwardly therefrom forming a channel to receive the lower end of the depending skirt. Annular beads formed on the interior wall of the depending skirt cooperate with a bead formed at the free edge of the container opening and with a relatively smooth outer skirt surface to restrict closure removal until the aforementioned wall means are torn away from the container. To facilitate such tearing, the wall means are provided with finger-engageable means and with suitably located weakenings to enable a tearing removal of the wall means by manual gripping and pulling of the finger-engageable means. In a modification, the central portion of the closure is recessed so as to project into the container and brace the interior sidewall of the container against radially inwardly directed forces.

22 Claims, 6 Drawing Figures

FIG-1
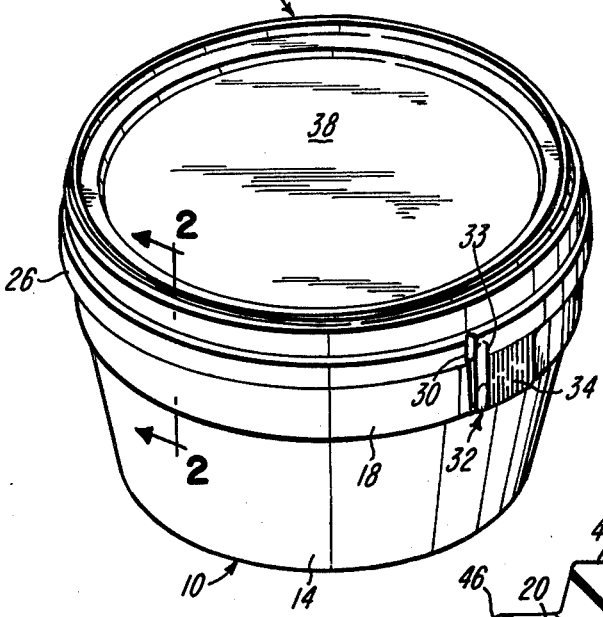
FIG-2
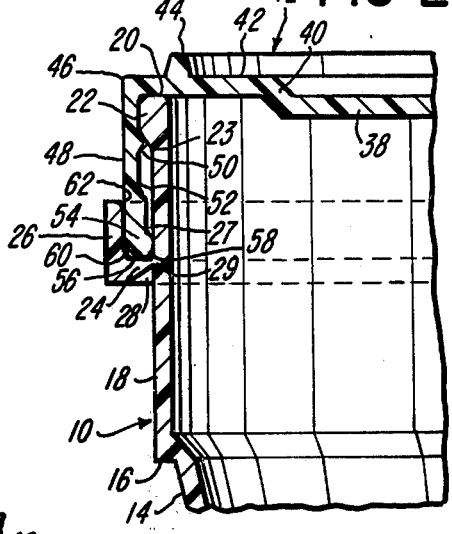
FIG-3
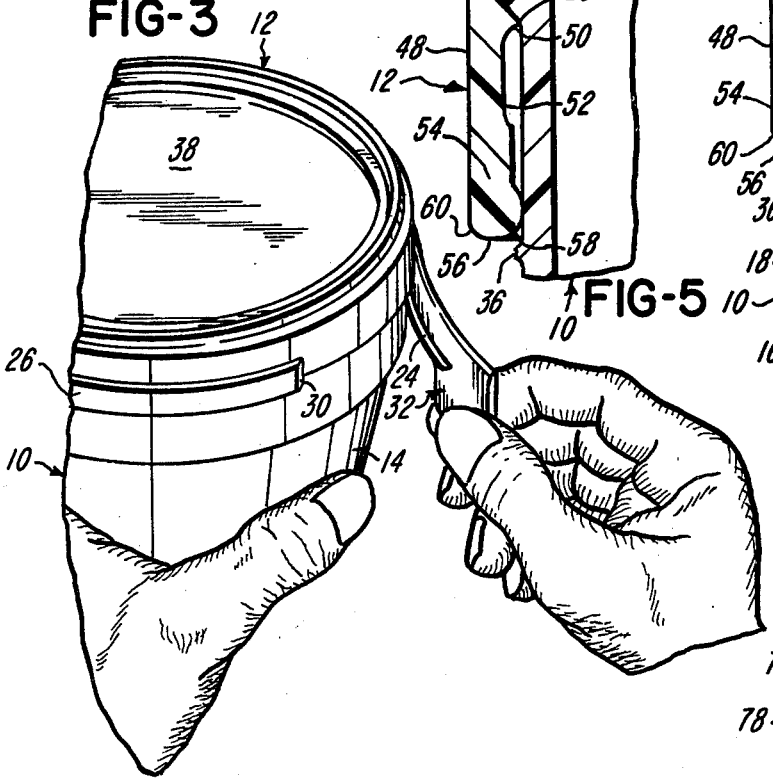
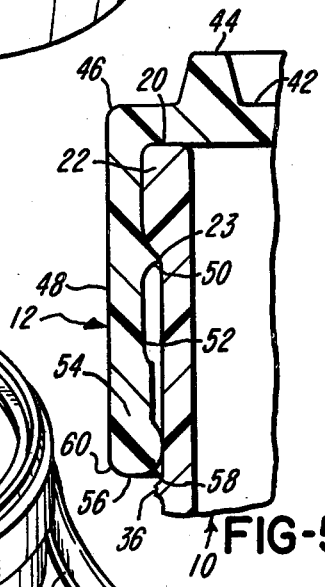
FIG-5
FIG-4
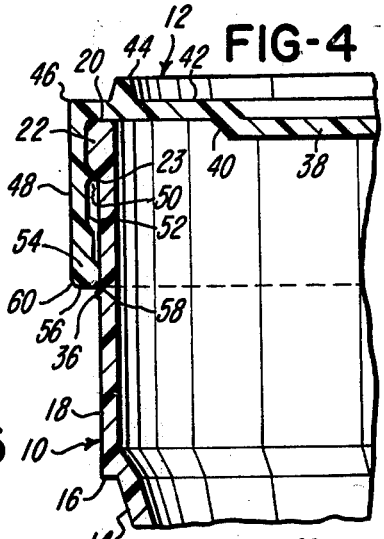
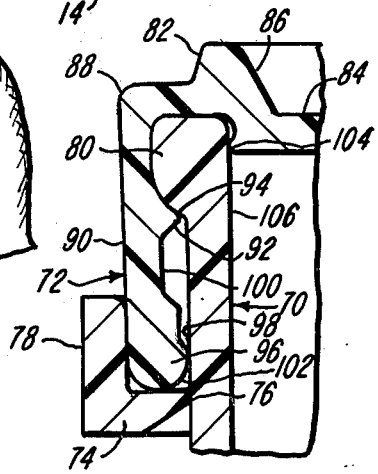
FIG-6

CONTAINER AND CLOSURE CONSTRUCTION FOR RESISTING TAMPERING

BACKGROUND OF THE INVENTION

The present invention relates to a tamper resistant closure and container assembly and, more particularly, to a closure and container assembly wherein the container has means integrally formed thereabout for receiving and protecting a closure skirt against unauthorized entry to the contents of the container.

It is known to sealingly close containers such as molded plastic food containers by means of a tearable or severable retention means which anchors the closure to the container until the severable means is removed from the closure. In many such arrangements known in the prior art, an unauthorized entry to the contents of the container can be made by working the fingers under the tearable portion of the closure or simply by exerting a sufficient upward force on the closure to work the closure off the container opening without damage to the tear strip. Thus, in some cases, an unauthorized entry can be accomplished without any visible indication that such entry has been accomplished.

SUMMARY OF THE INVENTION

According to the present invention, the opportunity for an unauthorized entry to the contents of the container is reduced by forming the portion which is tearable so as to allow an authorized entry to the contents of the container on the container rather than on the closure. More particularly, the tearable portion of the container is so formed as to provide an upwardly facing channel for receiving a depending skirt of the closure and for shielding the lower surfaces of the depending closure skirt from the type of prying forces that would enable one to force the closure off the container. Still more particularly, inwardly projecting beads of the closure skirt cooperate with an outwardly projecting bead on the container to create a disadvantage to closure removal until the tearable means forming the channel which shields the depending surfaces of the closure skirt has been torn away. To this end, suitable finger-engageable means cooperating with suitably located weakenings located in the tearable means permit a convenient authorized entry to the contents of the container.

In a modification, the central portion of the closure is recessed so as to project into the container and brace the interior sidewall of the container against radially inwardly directed forces such as could initiate a premature severance of the tearable means from the container.

An object of the present invention is to provide a new and improved container and closure assembly.

Another object of the present invention is to provide an improved container and closure assembly having tear strip means affixed to the container rather than to the closure.

Still another object of the present invention is to provide a container and closure assembly having beads which interlock in a fashion giving a mechanical disadvantage to unauthorized closure removal.

A further object of the present invention is to provide a container and closure assembly wherein a portion of the closure is recessed into the container so as to brace the container sidewall.

Yet another object of the present invention is to provide a new and improved method of accomplishing a tamper resistant closure for a container.

BRIEF DESCRIPTION OF THE DRAWINGS

In the drawings:

FIG. 1 is a perspective view illustrating the container and closure of the present invention in assembled relationship.

FIG. 2 is a fragmentary section view taken substantially along the line 2—2 of FIG. 1.

FIG. 3 is a perspective view illustrating manual operation to remove a tear strip from the container.

FIG. 4 is a fragmentary section view analogous to that of FIG. 2, showing the assembled container and closure after tear strip removal.

FIG. 5 is an enlarged fragmentary section view illustrating the upper left corner of FIG. 4.

FIG. 6 is an enlarged fragmentary section view illustrating a modification.

DESCRIPTION OF THE PREFERRED EMBODIMENTS

Referring to the drawings, the reference number 10 illustrates a container constructed in accordance with the present invention, and the reference number 12 identifies a closure constructed in accordance with the present invention. The container 10 can be seen to comprise a hollow body having an open end and having a divergent sidewall 14 which rises upwardly from the base of the container, which is not shown in detail in the drawings.

At an elevation from the base of the container, the sidewall 14 is reinforced by an annular, thickened shoulder 16. In addition to imparting stiffness to the container, which is a molded thermoplastic body, the shoulder 16 also functions to provide a stacking surface whereby empty containers may conveniently be stacked one on top of another for purposes of shipment and storage.

Above the shoulder 16 the container 10 has generally a right cylindrical shape, which is formed by a cylindrical wall 18 integral with and projecting upwardly from the divergent sidewall 14. When the container is rested with its base on a flat support surface, not shown, the wall 18 would extend generally vertically with respect to such supporting surface.

The wall 18 terminates distally from the base of the container with a free edge or margin 20 encircling the open end of the container and thickened by means of a radially outwardly projecting bead 22 adjacent the free edge of the container.

Intermediate the free edge 20 and the shoulder 16 the container has an integral, radially outwardly projecting wall 24 which supports at its radially outer end a vertically upwardly projecting wall 26, the walls 24 and 26 comprising a generally L-shaped wall means which, in cooperation with the vertical wall 18, forms an annular channel 27 encircling the wall 18.

As best seen in FIG. 2, the wall 24 is weakened by means of a notch 28 formed annularly in the lower surface of the wall 24 immediately adjacent the outer surface of the wall 18. In consequence of the formation of the notch 28, the wall 24 can be seen to be connected to the wall 18 by means of a weakened web 29, which is rather thin in relation to the thickness of the wall 18 and to the thickness of the wall 24 absent the notch 28.

As best appears in FIGS. 1 and 3, the wall 26 has been weakened in the molding thereof by providing therein a vertically disposed, V-shaped notch or score line 30. Immediately adjacent the notch 30 the wall 26 has a depending, finger-engageable tab 32, which slopes outwardly and is provided with knurling 34 to facilitate gripping of the tab 32 by the fingers of an operator. A thickened rib 33 reinforces the connection of the tab 32 to the wall 26 so that the tab is held against inadvertent removal from the wall 26.

As shown in FIG. 3, it is possible for an operator to grip the tab 32 with one hand and the container 10 with the other hand and, by exerting a force outwardly from the container 10, tear or sever the wall 26 along the score line 30 and then, by an orbital hand movement, tear the wall 24 along the weakened web 29 so as to remove the wall 26 and with it the major portion of the original wall 24, thus leaving only a remnant bead 36 on the container wall 18.

Referring now to the closure 12 and more particularly to FIG. 2, the closure is a molded plastic member having a recessed panel portion 38 surrounded by an annular step portion 40 which integrally connects the recessed panel 38 to an annular panel portion 42. The panel portion 42 terminates at its radially outer margin with a corner 46 from which depends a skirt 48. The annular panel portion 42 has an integrally formed, upwardly projecting stacking rib 44 which facilitates stacking of plural closures 12 one on top of another for purposes of shipment and storage.

The internal wall of the skirt 48 can be seen to have a radially inwardly projecting bead 50, which is contoured at its upper margin as it appears in FIG. 2 to interfit the curvature of the lower margin 23 of the container bead 22 so as to form a good seal with the container bead 22.

The skirt 48 can also be seen to have a thickened distal portion including a bead 54 and terminating distally with an edge 56. Between the inwardly projecting skirt beads 50 and 54 the skirt 48 has an annular recess or channel 52.

It will be understood that the closure 12 is ordinarily not assembled to the container 10 until such time as the container has been charged with the material to be contained, ordinarily a foodstuff. Assuming the container to have been charged with the foodstuff to be stored therein, the closure 12 is supported in an inclined position in the path of the container which is moved laterally to cause the container bead 22 to hook the skirt bead 54 at a lower portion of the then inclined closure. With continued lateral movement of the container and closure which now move in unison, the container and closure are moved under a roller, not shown, which progressively forces the closure skirt downwardly onto the container as the container and closure move under the roller.

It will be appreciated by those skilled in the art that as the closure is rolled onto the container after a lower portion of the closure has been hooked onto the container bead 22, diametrically opposite sides of the container will be pressed inwardly one toward the other by the closure skirt so as to cause the container to temporarily assume an oval configuration. This action permits the closure to slide easily over the container bead 22 as the closure is rolled onto the container. When the trailing portion of the container bead 22 passes under the aforementioned roller, the container configuration returns to a circular shape as the closure skirt snaps over the trailing portion of the bead 22 to enter the channel 27 formed by the container wall 26.

With one pass under the aforementioned roller, the closure bead 54 is driven fully into the channel 27. To facilitate movement of the closure 12 onto the container 10, the lower inside corner 58 of the skirt 48 is rounded, thus allowing the rounded surfaces of the skirt 48 and the bead 22 to slide one relative to the other. For a similar reason, the lower outside corner 60 of the skirt 48 and the upper inside corner 62 of the wall 26 are both rounded to move freely past one another. To accomplish the described assembly, it is important that at least one of the closure and container be of a resilient and stretchable material, such as a thermoplastic, so as to allow the closure to slide over the bead 22. In general, it is desirable that both the closure and the container comprise molded, one-piece plastic bodies.

After the closure 12 has been applied to the container 10 as described, the beads 50 and 54 on the inner wall of the skirt 48 cooperate to form air seals with the outer wall of the container 10, resisting interchange of air between the interior of the closed container 10 and the exterior of the container. It can be noted, of course, that the bead 22 adjacent the upper edge of the container wall is now acting to bias the container wall outwardly against the skirt 48, thus cooperating with the thickened distal portion of the skirt 48 to maintain firm contact between the beads 50 and 54 and the container wall 18.

An important feature of the present invention is that, when the closure 12 has been assembled to the container 10 as is illustrated in FIG. 2, a surreptitious entry to the container or inspection of its contents is essentially negated except in the event of a destructive entry to the container.

When considering the prospects for removal of the closure 12, it can be noted that the first event required to occur is that the bead 50 of the skirt 48 must now move radially outwardly in order to wipe over the container bead 22. However, such action is resisted by the container wall 26 under circumstances where the edge of the skirt 48 is shielded from the application of a manual pressure against the skirt. These factors combined with the absence of any exposed surfaces on the closure for secure manual gripping make it exceedingly difficult for the human hands, unaided by mechanical devices, to withdraw the closure from the container. Obviously, any attempt to diametrically squeeze exposed closure surfaces above the wall 26 merely enhances the security with which the beads 22 and 50 will retain the closure on the container.

It remains possible that one endeavoring to surreptitiously examine the contents of the container can exert an upward force on the container wall 24, thus commencing a tear of the weakened web 29. Of course, before the container contents could be examined, such tear would be readily visible to casual inspection, and the chances that foodstuffs which had been invaded in an unauthorized manner could be inadvertently sold are materially reduced. Thus the purchaser of foodstuffs or the like protected by the closure and container of the present invention is well protected against a purchase of foodstuffs which have been tampered with in any unauthorized fashion.

As already described, however, an authorized entry to the foodstuffs or the like stored in the container is readily available by grasping the tab 32 and, in the fashion previously described, removing from the container 10 the tear strip comprising the walls 24 and 26.

As illustrated in FIGS. 4 and 5, the container 10 and closure 12 remain reusable after the tear strip comprising the walls 24 and 26 has been removed, and the seals provided by the beads 50 and 54 remain effective. However, the further seal provided by engagement of the skirt by the walls 24 and 26 is then no longer available.

Having reference to FIG. 2, it can be observed that by a sufficient squeezing pressure applied by the fingers to diametrically opposite sides of the container 10 at regions immediately below the container wall 24, it may be possible to cause the wall 24 to tear from the container wall 18 at the weakened web 29. In many cases, such a phenomenon would not be encountered because the contents of the container 10 will have a sufficient stiffness or rigidity to brace the wall of the container 10 against the described squeezing forces. In other cases, particularly where the contents of the container are in the form of a liquid, it is desired to provide supplemental means for bracing the wall of the container 10. An example of a suitable brace for the wall of a container is illustrated in the modification appearing in FIG. 6.

This modification utilizes a container 70, which need not differ from the previously described container 10, and a modified closure 72.

The container 70 has a radially outwardly extending wall 74 and a vertically upwardly extending wall 78 joined to the outer end of the wall 74 to form an annular channel for receipt of the distal end of a closure skirt to be described. The radially outwardly extending wall 74 is, of course, provided with a weakened web 76 immediately adjacent the wall of the container 70 in the same fashion as the wall 24 of the first embodiment was weakened.

Referring to the closure 72, the closure is similar in many respects to the closure of the first embodiment. Thus the closure 72 is equipped with a stacking rib 82 somewhat analogous to the stacking rib 44 of the first embodiment. The closure 72 is also equipped with a recessed panel 84 analogous to the panel 42 of the first embodiment, but it will be noted that the sloping wall 86 extending from the upper surface of the stacking rib 82 to the upper surface of the recessed panel 84 is relatively less steep than the corresponding surface of the first embodiment. By having the sloping wall 86 relatively less steep, the possibility that one might pull the closure 72 off the container 70 by pinching the stacking rib 82 between fingernails or a suitable tool is materially reduced.

The closure 72 is possessed of a corner 88 from which depends a skirt 90 having a radially inwardly directed bead 92 adapted to engage the underside of the container bead 80 so as to retain the closure 72 on the container 70. It can be noted, of course, that the upper surface of the closure bead 92 is shaped to conform to the contoured lower surface 94 of the container bead 80.

The closure skirt can be seen to have a thickened distal portion including a bead 96, the internal surface of which provides a seal engaging the outer wall 98 of the container 70.

Between the skirt bead 92 and the thickened distal end of the skirt, the skirt has an annular recess 100 sized to accommodate the container bead 80 as the closure 72 is being placed upon the container. The closure is preferably rolled onto the container as described in reference to the first embodiment.

For the reasons described with reference to the first embodiment, the distal edge of the skirt has a rounded surface 102, the inside portion of such surface facilitating a sliding motion of the closure about the container bead 80 and the outer portion of the rounded surface 102 facilitating entry of the distal end of the skirt into the recess bounded by the container wall 78.

In an important departure from the first embodiment, the present modification has an internal bead 104 integrally formed with the recessed panel 84 and so located as to brace the internal wall 106 of the container when the closure has been assembled onto the container. By reason of the bracing action of the closure bead 104, the possibility that one pressing or squeezing the container wall below the container walls 74 and 78 so as to tear the weakened web 76 is materially reduced.

A further advantage afforded by the presence of the bead 104 is that the spacing between the bead 104 and the closure skirt 90 can be sized to assure that the bead 80 of the container will be compressively gripped therebetween, both before the container walls 74 and 78 have been removed and during subsequent reclosures of the container.

Although the preferred embodiments of the present invention have been described, it will be understood that various changes may be made within the scope of the appended claims.

Having thus described our invention, we claim:

1. An assembly comprising:

a molded one-piece plastic container having a generally upright wall portion bounding an opening thereto, a molded one-piece plastic closure having an integrally molded panel for covering said opening and a skirt surrounding said wall portion, said container and said closure having interfitting means to provide a snap fit therebetween so that a prying force must be applied to the distal edge of said closure skirt to remove said closure from said container, and closure shield means molded as part of said container projecting outwardly from and substantially surrounding said wall portion to shield said distal edge of said closure skirt sufficiently that it would be difficult to pry said closure from said container by manual manipulation without the aid of a mechanical device.

said closure shield means including a tearable section immediately adjacent said wall portion for severably attaching said shield means to said wall portion constructed so that said shield means may be sufficiently detached from said wall portion to expose said distal edge for manual manipulation so that said closure may be pried from said container without the aid of a mechanical device, said shield means comprising a first wall projecting outwardly from said wall portion, said tearable section comprising a reduced thickness portion of said first wall engaging said wall portion, said shield means further comprising a second wall projecting upwardly from the outer end of said first wall and generally parallel to said wall portion, said first and second walls cooperating with said wall portion to form a channel for receipt of the lower portion of said closure skirt.

2. The assembly of claim 1 wherein said interfitting means comprises a bead on said container surrounding said opening and an inwardly directed bead on said closure skirt sealingly engaged with said container bead and wherein there is a second inwardly directed bead on said closure skirt at its distal end engaged with said wall portion, said distal end including said second bead being located in said channel.

3. The assembly of claim 2 wherein there is a recess between said closure beads to accommodate said bead on said container and to permit said lower portion of said closure skirt to enter said channel during assembly of said closure onto said container.

4. In a molded one-piece plastic container having an opening bounded by a generally upright wall portion for use with a snap fit plastic closure having an integrally molded panel for covering said opening in said container and a skirt depending from the margin of said panel for surrounding said wall portion, the improvement wherein said container has closure shield means molded therewith substantially surrounding said wall portion and projecting outwardly from said wall portion at a spacing from said opening effective to shield the distal edge of said closure skirt sufficiently that it would be difficult to pry said closure from said container by manual manipulation without the aid of a mechanical device, said shield means having a tearable portion engaging said wall portion for severably attaching said shield means to said wall portion so that said shield means may be sufficiently detached from said wall portion to expose the distal edge of said closure skirt for manual manipulation so that said closure may be pried from said container without the aid of a mechanical device, said shield means comprising a first wall projecting outwardly from said wall portion and having said reduced thickness portion, said shield means further comprising a second wall projecting upwardly from the outer end of said first wall and generally parallel to said wall portion, said first and second walls cooperating with said wall portion to form a channel for receipt of the lower portion of said closure skirt.

5. In a flexible plastic container havling a relatively large open upper end for sealing with a press-on closure cap having a relatively shallow depending skirt, an improved tamperproofing means positioned adjacent to the open upper end and formed integrally with the container comprising:

a tamperproofing band spaced outwardly of the outer surface of the container adjacent to the open upper end of the container;

a lower portion only of said band being removably connected to the container by a frangible connecting means; and said tamperproofing band and said connecting means defining an upwardly facing channel with a fully open top for receiving at least the lower portion of a closure cap skirt whereby said band and said connecting means bar access to the lower edge of the skirt.

6. A container as claimed in claim 5 in which said band has a transverse line of weakness.

7. A container as claimed in claim 5 in which said connecting means comprises a score line.

8. A container as claimed in claim 5 in which said connecting means comprises a web.

9. A container as claimed in claim 5 in which said container comrpises a closure engaging bead adjacent to the said open top.

10. A container as claimed in claim 5 in which said container comprises a closure engaging groove adjacent to the open top.

11. A container as claimed in claim 5 in which said container comprises polyethylene.

12. A container as claimed in claim 5 in which said container comprises a thermoplastic.

13. A container as claimed in claim 5 in which said container comprises a molded flexible plastic.

14. A sealed package comprising:

a flexible plastic container having an open upper end sealed with a closure cap having a relatively shallow depending skirt;

a tamperproofing band spaced outwardly of the outer surface of the container adjacent to the open upper end of the container;

a lower portion only of the band being removably connected to the container by a frangible connecting means; and said tamperproofing band and said connecting means defining an upwardly facing channel with a fully open top receiving the lower portion of the closure cap skirt whereby said band and said connecting means bar access to the lower edge of the skirt.

15. A package as claimed in claim 14 in which said band has a transverse line of weakness.

16. A package as claimed in claim 14 in which said connecting means comprises a score line.

17. A package as claimed in claim 14 in which said connecting means comprises a web.

18. A package as claimed in claim 14 in which said container comprises a closure engaging bead adjacent to the said open top.

19. A package as claimed in claim 14 in which said container comprises a closure engaging groove adjacent to the open top.

20. A package as claimed in claim 14 in which said container comprises polyethylene.

21. A package as claimed in claim 14 in which said container comprises a thermoplastic.

22. A package as claimed in claim 14 in which said container comprises a molded flexible plastic.

* * * * *

UNITED STATES PATENT AND TRADEMARK OFFICE

CERTIFICATE OF CORRECTION

PATENT NO. : 4,190,175

DATED : February 26, 1980

INVENTOR(S) : David O. Allen

It is certified that error appears in the above-identified patent and that said Letters Patent are hereby corrected as shown below:

Column 6, line 44 "." should be ---,---
Column 7, line 39 "havling" should be ---having---

Signed and Sealed this

*First* Day of *July 1980*

[SEAL]

*Attest:*

SIDNEY A. DIAMOND

*Attesting Officer*

*Commissioner of Patents and Trademarks*